US006499759B2

(12) United States Patent
DeBorde et al.

(10) Patent No.: US 6,499,759 B2
(45) Date of Patent: Dec. 31, 2002

(54) ALPINE SKI

(75) Inventors: Henri DeBorde, Bilieu (FR); Jérôme Noviant, Voiron (FR); Thierry Schrobiltgen, Attignat-Oncin (FR); Johan Vailli, La Murette (FR); Jean-Christophe Godde, Chimilin (FR)

(73) Assignee: Skis Rossingol S.A., Voiron (FR)

( * ) Notice: Subject to any disclaimer, the term of this patent is extended or adjusted under 35 U.S.C. 154(b) by 0 days.

(21) Appl. No.: 09/771,726

(22) Filed: Jan. 29, 2001

(65) Prior Publication Data

US 2001/0013694 A1 Aug. 16, 2001

(30) Foreign Application Priority Data

Jan. 28, 2000 (FR) ..... 00 01102

(51) Int. Cl.[7] ..... A63C 5/048
(52) U.S. Cl. ..... 280/609; 280/602
(58) Field of Search ..... 280/602, 609, 280/610, 601, 608

(56) References Cited

U.S. PATENT DOCUMENTS

| | | | | | |
|---|---|---|---|---|---|
| 4,639,009 | A | * | 1/1987 | Meatto et al. | 280/602 |
| 5,301,965 | A | * | 4/1994 | Floreani | 280/600 |
| 5,405,161 | A | * | 4/1995 | Petkov | 280/609 |
| 5,603,522 | A | | 2/1997 | Nelson | |
| 5,642,897 | A | * | 7/1997 | Couderc et al. | 280/605 |
| 5,871,225 | A | * | 2/1999 | Sutherland | 280/609 |
| 5,915,717 | A | * | 6/1999 | Faye | 280/602 |
| 6,149,182 | A | * | 11/2000 | Wyssen | 280/626 |

FOREIGN PATENT DOCUMENTS

| | | |
|---|---|---|
| FR | 2 559 673 | 8/1985 |
| WO | WO 96/22135 | 7/1996 |

* cited by examiner

*Primary Examiner*—Avraham Lerner
(74) *Attorney, Agent, or Firm*—Heslin Rothenberg Farley & Mesiti P.C.; Victor A. Cardona, Esq.

(57) ABSTRACT

Alpine ski (1) which can be broken down over its length into a tip area (2), a binding area (3) and a heel area (4), in which the side line is such that the binding area (3) has a minimum width level ($L_P$), the tip area (2) has a front maximum width level ($L_S$), and the heel area (4) has a rear maximum width level ($L_T$), characterized in that:

the radius of the side line, calculated on the basis of three points (5, 6, 7) on the side line, respectively a first point (5) located at the front maximum width level ($L_S$), a second point (7) located at the rear maximum width level ($L_T$), and a third point (6) located centrally between the levels ($L_S$, $L_T$), is between 7 and 21 meters;

the pressure distribution along the side line is such that, when the ski is placed on a flat surface (20) so that its underside (22) forms an angle ($\alpha$) of 45° with the flat surface (20), and when the ski receives, at the location of the center of the boot, a force ($F_5$) of 400 Newtons perpendicularly to its underside (22), the pressures measured along the side line differ by less than 10% from the average value of the three pressures measured respectively at the rear maximum width level ($L_T$), at the minimum width level ($L_P$) and at the front maximum width level ($L_S$).

6 Claims, 2 Drawing Sheets

Pressure distribution at 45° (load=40 kg)

Pressure distribution on the edge at 45° (load=40kg)

ALPINE SKI

TECHNICAL FIELD

The invention relates to the field of gliding sports and more precisely to that of alpine skiing. It relates to a board geometry for a small ski which is nevertheless particularly manoeuvrable whilst retaining a behaviour which is substantially equivalent to that of a ski of conventional size.

PRIOR ART

Conventionally, the optimum length of a ski is determined as a function of the height of the user, and of the latter's weight and technical ability.

Therefore, current opinion holds that a ski must have a length which is substantially between approximately 10 and 20 centimeters longer than the height of the user.

In practice, the longer a ski, the more it tends to keep to its course and to allow precise skiing. Conversely, the shorter a ski, the more frequently floating phenomena are observed, particularly when skiing at high speed.

Nevertheless, the greater length of the skis makes them more difficult to manoeuvre and requires more effort on the part of the skier, particularly when skiing turns.

Thus, it is known that the issue of the size of a ski must make it possible to obtain a compromise between manoeuvrability and skiing precision.

Numerous developments in the geometry and determination of the lengths of skis have already been proposed, but these have not made it possible to achieve optimum solutions.

It has thus already been proposed, within a range of skis called "compact skis" to greatly reduce the size of a ski, by approximately 20 centimeters with respect to the conventional size, and to make the tip wider. Such skis were intended for use by intermediate skiers, to allow versatile skiing. These skis were fairly easy to ski on but gave a relatively poor performance.

Further developments in the field of skiing were also proposed in document FR 2 559 673, consisting particularly in making very deep sidecuts to allow turns to be carved. This practice requires very good physical condition. Such skis are thus relatively difficult to ski on, unstable in a straight line, when the skis are flat, and are not versatile.

Another parameter involved in the design of a ski is its stiffness in terms of flexion. This stiffness makes it possible to distribute the skier's weight over the snow. It is defined more or less empirically by ski manufacturers in such a manner that, with the ski placed flat, the maximum load is located under the skier's feet, this load diminishing towards the ends of the ski.

These various parameters are involved in the production of a ski, usually with paradoxical consequences. Therefore:

- a reduction in the length may give rise to a reduction in the weight and thus the stability of the ski, but also a reduction in the inertia, enhancing its manoeuvrability;
- a small side line radius leads to an increase in the mass at the ends of the ski, therefore to an increase in its inertia, but also to an interference with the stability of the ski when it is flat on the snow.

An attempt was made, particularly in document U.S. Pat. No. 5,603,522, to determine the load-bearing surface of the ski with respect to its polar moment of inertia in order to improve its manoeuvrability by reducing the forces necessary for turn initiation. The load-bearing surface is a parameter which is involved only when the ski is flat. In point of fact, during a turn, a ski bears on its edge line, so this document provides no useful teaching for improving the behaviour during a turn.

One of the objectives of the invention is to provide a ski which is shorter than the skis which are conventionally used for a given user height, which allows satisfactory precision in skiing via the effective transmission of the forces exerted by the skier over the entire length of the side line.

Side line or edge line is understood to mean the curve defined by the sharp portion of the edge from one end to the other of the ski. It is generally measured by determining the distance variation of the sharp portion of the edge with respect to the longitudinal mid plane of the ski.

SUMMARY OF THE INVENTION

The invention thus relates to an alpine ski which is broken down over its length into a tip area, a binding area, and a heel area, and in which the side line is such that the binding area has a minimum width level, the tip area has a front maximum width level, and the heel area has a rear maximum width level.

An alpine ski according to the invention is characterized by the combination of a plurality of dimensional mechanical parameters which thus make it possible to achieve the same behaviour as conventional skis which are approximately 20 centimeters longer, but thus at the same time to enhance the manoeuvrability of the ski.

Thus, according to the invention, the radius of the side line, calculated on the basis of three points on the side line which are located respectively at the rear maximum width level, and the front maximum width level and centrally between these two levels, is between 7 and 21 meters.

Moreover, the pressure distribution on the edge is one of the predominant parameters in the satisfactory operation of a ski, i.e. in its ability to initiate a turn and to keep to its course without skidding or chattering.

The ski according to the invention therefore has an edge pressure distribution along the side line such that, when the ski is placed on a flat surface, so that its underside forms an angle of 45° with the said flat surface, and when the ski receives, at the location of the center of the boot, a force of 400 Newtons perpendicularly to its gliding surface, the pressures measured along the side line differ by less than 10% from the average value of the three pressures measured respectively at the rear maximum width level, at the minimum width level of the binding area, and at the front maximum width level.

In other words, by virtue of the ski according to the invention, the forces exerted by the skier, particularly when executing a turn, are very regularly and quasi uniformly distributed along the edge line, which ensures optimum skiing of the turn.

In point of fact, the skis of the prior art have a pressure distribution on the edge line which is such that the majority of the forces are transmitted to the level of the binding area, and more precisely in line with the boot, whilst the front and rear areas of the board transmit only a very small portion of the forces.

This stiffness adjustment is obtained correctly either by adding reinforcements in the appropriate areas or by adjusting the thickness of the ski so as to vary the distance of the reinforcements with respect to the neutral fiber.

Advantageously, in practice, the distribution of pressures along the edge line is such that the pressure value measured at the location of the maximum width of the heel is slightly greater than the pressure value measured at the level of the maximum width of the tip.

In other words, the forces exerted by the skier during a turn are distributed quasi uniformly between the front and the rear of the ski since, during a turn, the force exerted by the skier is positioned in front of the center of the boot, which offsets the characteristic pressure distribution determined with a static load located exactly at the level of the center of the boot.

It was observed that the behaviour of the ski was very favorable when the pressure value measured at the level of the maximum width of the heel is greater by approximately 10% than the pressure value measured at the maximum width level of the tip.

Moreover, the skis according to the invention are shorter than conventional skis. However, they are not equivalent to shorter conventional skis, i.e. the skis normally used either by short people or by children, or by persons of low weight or of low muscle mass.

In fact, the ski according to the invention must be stiffer in terms of flexion in order to withstand considerable loads and more powerful impulses.

Thus, it was determined that, when considering the load-bearing length of the ski defined between the front contact lines and the rear contact lines, the stiffness of the ski according to the invention is such that, when the ski is placed flat between two supports, and when a force of 400 Newtons is exerted perpendicularly to the upper face of the ski midway between the two supports, the point located midway between the two supports is displaced downwards with respect to the situation in which the load is absent

- by a distance of between 60 and 70 millimeters when the supports are located respectively at the rear contact line and at $5/18^{ths}$ of the load-bearing length measuring from the rear contact line;
- by a distance of between 50 and 60 millimeters when the supports are located respectively at $5/18^{ths}$ of the load-bearing length measuring from the rear contact line and at $13/18^{ths}$ of the load-bearing length measuring from the rear contact line;
- by a distance of between 65 and 75 millimeters when the supports are located respectively at the front contact line and at $5/18^{ths}$ of the load-bearing length measuring from the front contact line.

Such stiffness thus helps to give the shorter ski a behaviour pattern which is equivalent to that of a longer ski.

In practice, the skis according to the invention have a total length, measured between the front and rear ends of the ski, of between 1 300 and 1 740 millimeters.

This is a range which corresponds to a range of conventional skis which are approximately 20 centimeters longer.

Advantageously, in practice, the ski according to the invention has a side line such that:

- its width measured at the front maximum width level is between 102 and 108 millimeters;
- its length measured at the minimum width level is between 64 and 70 millimeters;
- its width measured at the rear maximum width level is between 92 and 100 millimeters.

BRIEF DESCRIPTION OF THE FIGURES

The manner in which the invention is implemented and the advantages arising therefrom will become clearly apparent from the description of the embodiments which follow, with the assistance of the appended figures, in which.

EMBODIMENT OF THE INVENTION

As already stated, the invention relates to an alpine ski in which the geometry and stiffness distribution differ from the prior art in order to give a short ski the behaviour of a conventional ski of markedly greater length.

Such a configuration therefore makes it possible very markedly to enhance the manoeuvrability of the ski during use and maintenance operations when it is not being used.

As already stated, the ski according to the invention is characterized by a number of dimensional and mechanical parameters which, in combination, make it possible to optimize the behaviour of the ski.

Thus, the skis according to the invention have sizes which are markedly smaller than the sizes customarily used by skiers of equivalent level.

A size correspondence table is therefore reproduced below, in which the first column corresponds to the sizes, in centimeters, of conventional skis, and the second column corresponds to the size of skis according to the corresponding invention.

| Conventional ski size | Size of ski according to the invention |
|---|---|
| 195 | 174 |
| 184–191 | 167 |
| 184–177 | 160 |
| 177–160 | 150 |
| 160 | 140 |
| 150 | 130 |

Thus, it will be observed that the skis according to the invention have a size which is between 10 and 20 centimeters smaller than conventional skis, although they exhibit the same behaviour, making it possible to envisage considerable gains in manoeuvrability and also overall bulk.

Figure 1:
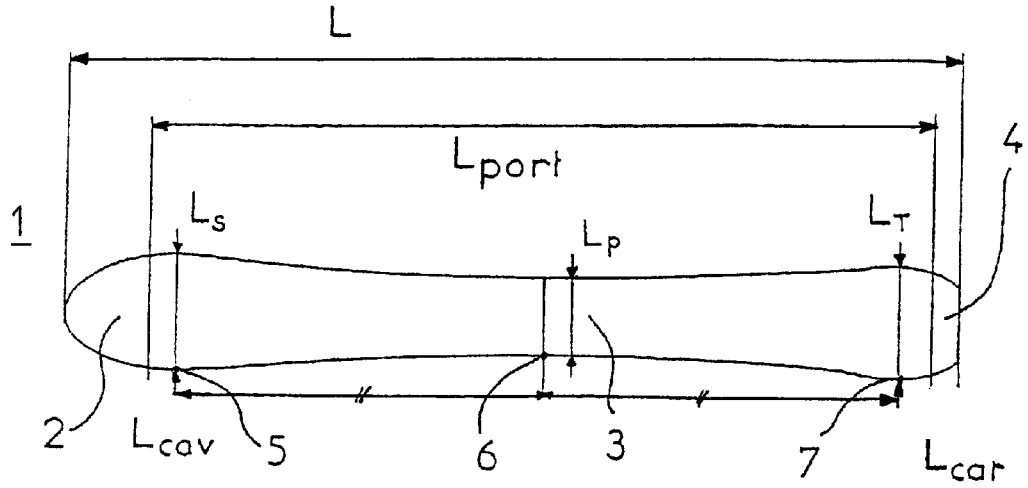
FIG. 1 is a top view of a ski according to the invention.

Thus, as illustrated in FIG. 1, a ski (1) according to the invention has a tip (2) whose maximum width (Ls) is between 102 and 108 millimeters, whose binding area (3) has a minimum width (Lp) of between 64 and 70 millimeters, whilst the heel (4) has a maximum width (Lt) of between 92 and 100 millimeters.

In a particular example of a ski of 167-centimeter size, the tip has a maximum width of 103 millimeters, the binding area a minimum width of 65 millimeters and the heel a maximum width of 93 millimeters.

As skis according to the invention are shorter than conventional skis, they are wider, particularly at the tip and at the heel, in order to offer an equivalent load-bearing surface area.

Measurement of the load-bearing surface area of a ski according to the invention of 167-cm size is 0.108 $m^2$ as compared with the 0.114 $m^2$ of a conventional ski of 191-cm size with equivalent behaviour.

The definition of a side line is also translated by the value of the theoretical radius passing via three points (5, 6, 7) of the side line which are located respectively as illustrated in FIG. 1. The first point (5) is located at the maximum width level of the tip (2). The second point (7) is located at the maximum width level of the heel (4). The third point (6) is located on the side line, equidistant from the two other points (5, 7) of maximum width.

The ski whose particular parameters are defined hereinabove has a theoretical radius of curvature equal to 16.4 meters as compared with the theoretical radius of curvature of a corresponding conventional ski which is approximately 30 meters.

Quite obviously, the invention is not limited to this single side-line radius value, but covers the different variants in which the side-line radius is between 7 and 21 meters.

Moreover, in order to obtain the desired behaviour, the ski according to the invention must have increased stiffness over the equivalent ski of greater size, in order, firstly, to withstand greater loads and, secondly, more powerful impulses.

Figure 2:
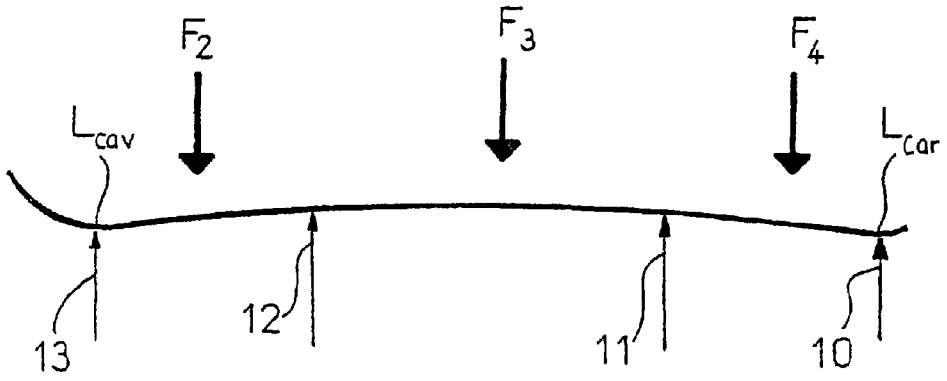
FIG. 2 is a diagrammatic side view of a ski according to the invention.

In practice, the stiffnesses are measured as follows (see FIG. 2).

The ski is placed flat between two supports and receives a load ($F_2$,$F_3$,$F_4$) of 40 kg, corresponding to half the weight of a skier of 80 kg. This 40-kg load is applied at a point equidistant from the two supports.

The measurement of the deflection in millimeters, corresponding to the vertical displacement of the point of application of the load, gives the stiffness of the portion of the ski measured.

Three measurements are made, respectively at the heel (4), in the binding area (3) and at the tip (2).

The stiffness of these various areas is determined by positioning various supports at precise positions.

Firstly, it is necessary to determine the load-bearing length ($L_{PORT}$) of the ski, measured between the two lines of front contact ($L_{CAV}$) and rear contact ($L_{CAR}$) which are defined in a standardized manner.

In order to measure the stiffness of the heel (4), a first support (10) is placed at the location of the rear contact line ($L_{CAR}$), the other support (11) being placed further forward, at a distance equal to $5/18^{ths}$ of the load-bearing length ($L_{PORT}$).

In order to measure the stiffness of the binding area (3) a first support (11) is arranged at $5/18^{ths}$ of the load-bearing length, starting from the rear contact line ($L_{CAR}$).

The second support (12) is placed forwards of this first support (11), at a distance equal to $4/9^{ths}$ of the load-bearing length ($L_{PORT}$). In order to measure the stiffness in the tip area (2), the front support (12) of the measurement of the stiffness in the binding area is retained, the second support (13) thus being placed at the location of the front contact line ($L_{CAV}$).

These two supports are, by deduction, separated by a distance equal to $5/18^{ths}$ of the load-bearing length.

In practice, for a ski of 167-centimeter size, having a load-bearing length of 1 435 millimeters, the supports are respectively placed at the following distances, counting from the rear contact line ($L_{CAR}$):

| | |
|---|---|
| Heel area | 0 and 399 millimeters |
| Binding area | 339 millimeters and 1 036 millimeters |
| Tip area | 1 036 millimeters and 1 435 millimeters |

The deformations or deflections of the various areas of the particular ski described hereinabove are as follows:

Heel area: 65 millimeters deformation

Binding area: 51 millimeters deformation

Tip area: 70 millimeters deformation.

Naturally, the invention is not restricted to these single values for determining the stiffness, but covers more extensive ranges for which the deformation in the heel area is between 60 and 70 millimeters, the deformation in the binding area is between 50 and 60 millimeters, and the deformation in the tip area is between 65 and 75 millimeters.

It should be noted that, in the case of a conventional ski which behaves identically to the aforesaid ski, the deformations at the heel and at the tip are respectively 94 and 92 millimeters, reflecting markedly less stiffness.

Moreover, a further mechanical parameter of the ski according to the invention relates to the pressure distribution over the edge which is particularly constant in comparison with the distribution measured on a conventional ski, which proves to be markedly irregular, with a clear pressure maximum measured at the location of the binding area.

Thus, in order to measure this parameter, the ski (1) is placed on a test bench equipped with pressure sensors arranged at regular intervals, each spaced by 8 millimeters.

Figure 3:
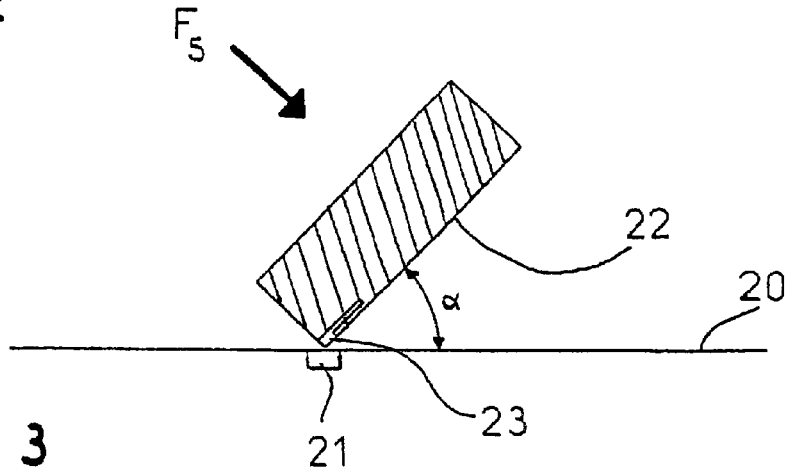
FIG. 3 is a diagrammatic section of a ski according to the invention, shown during the test for measuring the pressure distribution over the edge line.

The ski is placed on this test bench (20) in such a manner that its underside (22) forms an angle ($\alpha$) of 45° with respect to the test bench (20) as illustrated in FIG. 3.

The ski receives a force ($F_5$) exerted by an appropriate device, of an intensity of 400 Newtons, corresponding substantially to half the weight of the skier of 80 kg, this force being exerted perpendicularly to the gliding surface (22) of the ski.

Under load, the ski is deformed until the sharp portion of the edge (23) comes into contact, over its entire load-bearing length, with the test bench (20), which therefore makes it possible, by means of gauges (21) to measure the pressure at each of the points on the side line, at intervals of the order of 8 millimeters.

It should be noted that, prior to application of the load, the ski rests obliquely on its two points of maximum width, at the tip and at the heel. Next, under load, the ski bends, i.e. the binding area descends below its end areas until it is pressed on the measurement bench. As a function of the shape of the side line and of the specific stiffnesses of each area, the force sensors (21) measure the pressure applied.

Figure 4:
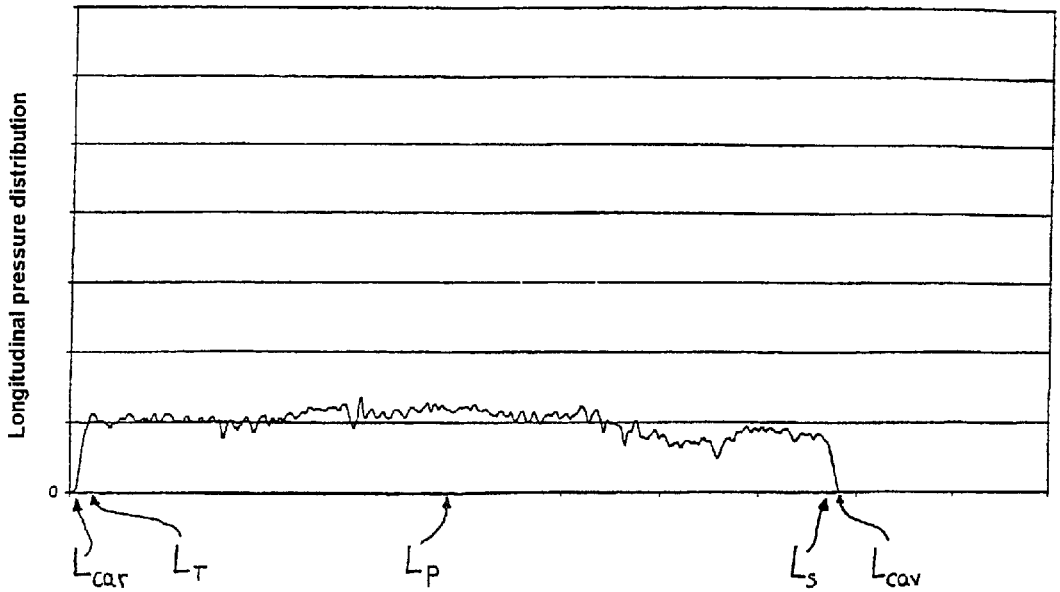
FIG. 4 is a diagram illustrating the pressure variation along the side line of the ski according to the invention.

The result is illustrated in FIG. 4, in which the variation in pressure over the entire length of the side line can be observed.

The measurement given as the ordinate is a pressure value, whereas the abscissa represents the length of the ski. In order to take account of the distributions measured on skis of different sizes, the pressure value is not calibrated, but corresponds to relative levels.

These values deviate by less than 10% from the average value of the pressure, which corresponds to quasi uniformity of the pressure along the side line. It is thus possible to observe that the pressures measured over the entire length of the side line vary between a minimum value and a maximum value, the deviation of which corresponds at most to 20% of the average value.

In practice, it was observed that the behaviour was optimum when the pressure value measured at the rear of the ski was greater by the order of 10% than the pressure measured in the front portion of the ski.

Figure 5:
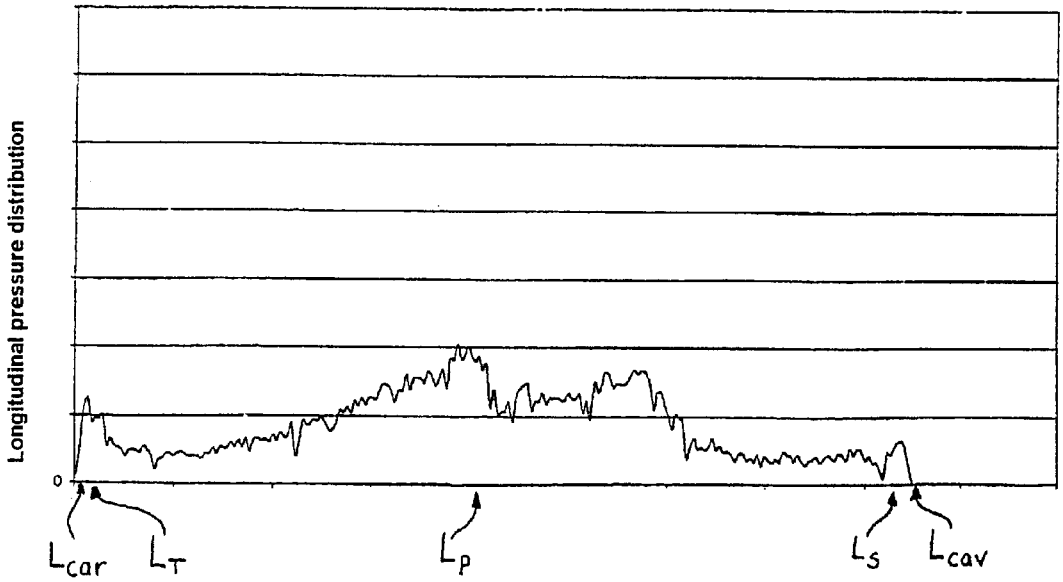
FIG. 5 is an equivalent diagram, corresponding to a ski of the prior art.

By way of comparison, FIG. 5 illustrates the distribution of the pressure measured using the same technique on a conventional ski of 191-centimeter size, corresponding in terms of behaviour to that of the ski of 167 size according to the invention.

It can very clearly be observed that most of the pressure is transmitted at the level of the binding area and much more lightly at the level of the front and rear contact line, the pressure in the intermediate areas respectively forward of the rear contact line and behind the front contact line being extremely small and less than one third of the maximum pressure measured at the level of the binding area.

By virtue of a pressure distribution according to the invention, when the skier skis his turn all the edge exerts a substantially identical pressure on the snow, which results in a highly satisfactory turn initiation and enhanced skiing of the turn.

It emerges from the aforesaid that the combination of the various dimensional and mechanical parameters of the ski according to the invention enables the ski to exhibit a behaviour which is identical to that of a ski which is approximately 20 centimeters longer, whilst enhancing manoeuvrability and ease of turn initiation.

Furthermore, as the skis according to the invention are shorter, they are much easier to store and to transport.

What is claimed is:

1. Alpine ski (1) which comprise a tip area (2), a binding area (3) a heel area (4) and a side line, wherein said side line comprises a minimum width level ($L_P$) in said binding area, a front maximum width level ($L_S$) in said tip area, and a rear maximum width level ($L_T$) in said heel area, wherein:

the radius of the side line, calculated on the basis of a first point (5) located at the front maximum width level ($L_S$), a second point (7) located at the rear maximum width level ($L_T$), and a third point (6) located centrally between said first point and said second point ($L_S$, $L_T$), is between 7 and 21 meters;

a pressure distribution along the side line is such that, when the ski is placed on a flat surface (20) so that its underside (22) forms an angle ($\alpha$) of 45° with a flat surface (20), and when the ski receives a force ($F_5$) of 400 Newtons perpendicularly to its underside (22) in said binding area, each of a plurality of pressures measured at a plurality of points along the side line differ by less than 10% from an average value of pressures measured at the rear maximum width level ($L_T$), at the minimum width level ($L_P$) and at the front maximum width level ($L_S$).

2. Ski according to claim 1, characterized in that the pressure distribution along the side line is such that, when the ski is placed on a flat surface (20) so that its underside (22) forms an angle ($\alpha$) of 45° with the said flat surface (20), and when the ski receives a force ($F_5$) of 400 Newtons perpendicularly to its underside, the pressure value measured at the location of the rear maximum width ($L_T$) is greater than the pressure value measured at the location of the front maximum width ($L_S$) .

3. Ski according to claim 2, characterized in that the pressure distribution along the side line is such that, when the ski is placed on a flat surface (20) so that its underside (22) forms an angle ($\alpha$) of 45° with the said flat surface (20), and when the ski receives a force ($F_5$) of 400 Newtons perpendicularly to its underside, the pressure value measured at the location of the rear maximum width ($L_T$) is greater by at least 10% than the pressure value measured at the location of the front maximum width ($L_S$).

4. Ski according to claim 1, having a front contact line ($L_{CAV}$) and a rear contact line ($L_{CAR}$) which are separated by the load-bearing length ($L_{PORT}$) of the ski, characterized in that its stiffness is such that, when the ski is placed flat between two supports (10, 11, 12, 13), and when a force ($F_2$,$F_3$,$F_4$) of 400 Newtons is exerted perpendicularly to the upper face of the ski midway between the two supports, the point located midway between the two supports is displaced downwards with respect to the situation in which the load is absent by a distance of between 60 and 70 millimeters when the supports (10, 11) are located respectively at the rear contact line ($L_{CAR}$) and at $5/18^{ths}$ of the length ($L_{PORT}$) measuring from the rear contact line ($L_{CAR}$);

by a distance of between 50 and 60 millimeters when the supports (11, 12) are located respectively at $5/18^{ths}$ of the load-bearing length ($L_{PORT}$) measuring from the rear contact line ($L_{CAR}$) and at $13/18^{ths}$ of the load-bearing length ($L_{PORT}$) measuring from the rear contact line ($L_{CAR}$);

by a distance of between 65 and 75 millimeters when the supports (12, 13) are located respectively at the front contact line and at $5/18^{ths}$ of the load-bearing length measuring from the front contact line ($L_{CAV}$).

5. Ski according to claim 1, characterized in that its total length L measured between the front and rear ends of the ski is between 1 300 and 1 740 millimeters.

6. Ski according to claim 1, characterized in that:

its width measured at the front maximum width level $L_S$ is between 102 and 108 millimeters;

its length measured at the minimum width level $L_P$ is between 64 and 70 millimeters;

its width measured at the rear maximum width level $L_T$ is between 92 and 100 millimeters.

* * * * *